US007722443B2

(12) United States Patent
Levsen

(10) Patent No.: US 7,722,443 B2
(45) Date of Patent: May 25, 2010

(54) KNIFE BLADE DRESSING APPARATUS

(75) Inventor: Clark A. Levsen, Shawnee, KS (US)

(73) Assignee: Hantover, Inc., Kansas City, MO (US)

( * ) Notice: Subject to any disclaimer, the term of this patent is extended or adjusted under 35 U.S.C. 154(b) by 0 days.

(21) Appl. No.: 12/352,654

(22) Filed: Jan. 13, 2009

(65) Prior Publication Data

US 2009/0124181 A1 May 14, 2009

Related U.S. Application Data

(63) Continuation of application No. 11/859,679, filed on Sep. 21, 2007, now abandoned.

(51) Int. Cl.
*B24B 7/17* (2006.01)

(52) U.S. Cl. ..... 451/262; 76/87; 451/45; 451/261; 451/321; 451/527; 451/551

(58) Field of Classification Search ..... 76/12, 76/81.7, 87; 451/45, 65, 261, 262, 321, 527, 451/548, 551

See application file for complete search history.

(56) References Cited

U.S. PATENT DOCUMENTS

| | | | | | |
|---|---|---|---|---|---|
| 466,293 | A * | 12/1891 | Peer | 451/486 |
| 2,039,578 | A * | 5/1936 | Blount | 451/551 |
| 2,646,653 | A * | 7/1953 | Murchison | 451/486 |
| 3,032,938 | A * | 5/1962 | Voll | 451/549 |
| 4,672,778 | A * | 6/1987 | Rieser | 451/486 |
| 6,012,971 | A * | 1/2000 | Friel et al. | 451/45 |
| 6,196,911 | B1 * | 3/2001 | Preston et al. | 451/548 |
| D463,965 | S * | 10/2002 | Lee et al. | D8/70 |
| 6,551,181 | B2 * | 4/2003 | Lee et al. | 451/548 |
| 6,814,657 | B2 * | 11/2004 | Spangenberg et al. | 451/548 |
| 7,172,499 | B2 * | 2/2007 | Eklund | 451/261 |
| 7,198,558 | B2 * | 4/2007 | Levsen | 451/263 |
| 7,364,502 | B2 * | 4/2008 | Ficai | 451/548 |
| 7,506,644 | B2 * | 3/2009 | Park | 125/22 |

* cited by examiner

*Primary Examiner*—Timothy V Eley
(74) *Attorney, Agent, or Firm*—Hovey Williams LLP

(57) ABSTRACT

A dressing device for sharpening or conditioning of a blade or the like includes one or more disk pairs each having a pair of disks respectively presenting a plurality of ribs. The disks are oriented in face-to-face relationship with the ribs thereof in meshed, intercalated relationship to thereby create circumferential dressing openings. The ribs are configured to create sharpened edge on a knife blade or the like.

25 Claims, 5 Drawing Sheets

KNIFE BLADE DRESSING APPARATUS

RELATED APPLICATIONS

This application is a continuation of application Ser. No. 11/859,679, filed Sep. 21, 2007, entitled KNIFE BLADE DRESSING APPARATUS, which is hereby incorporated in its entirety herein.

BACKGROUND

1. Field

The present invention is broadly concerned with blade dressing devices for the sharpening or conditioning of knife blades or other elongate objects or utensils. More particularly, the invention is concerned with dressing devices of the type including a pair of rotatable disks cooperatively defining a circumferential dressing opening, in which a knife or the like is dressed (i.e., sharpened or steeled).

2. Related Art

Man has required a means for sharpening knives, blades, and other edged utensils for thousands of years. The simplest sharpening device is an abrasive sharpening stone which is drawn over a blade or the like in an effort to create a sharpened edge. Effective sharpening using such stones requires considerable skill. A wide variety of more sophisticated sharpening devices have also been proposed, such as V-notch sharpeners intended to simultaneously sharpen both edge faces of a blade. Generally, these V-notch sharpeners do not provide any integrated control of blade angle, but depend upon the skill of the user to properly orient the blade for sharpening.

U.S. Pat. No. 2,646,653 describes a knife sharpening apparatus including a pair of opposed, toothed disks which cooperatively define a circumferential knife-receiving opening. Each disk has spaced apart, inclined, projecting teeth which mesh with the teeth of the opposing disk. The disks are also biased together by means of a spring arrangement. Other types of sharpening devices are illustrated in U.S. Pat. Nos. 989,692, 5,390,431, 4,090,418, 4,685,250, 6,290,582, 5,655,959, 4,672,778, 5,390,445, 5,478,272, 4,807,399, 6,012,971, and 7,198,558, as well as published Patent Application No. U.S. 2004/0171337.

U.S. Pat. No. 7,198,558 (the '558 patent), assigned of record to the assignee of the present application, describes a blade dressing device including a pair of rotatable, toothed, biased-together disks cooperatively defining a circumferential dressing opening, in which a knife or the like is dressed. The disks described in the '558 patent have concave dressing surfaces, with each of the teeth forming one of the dressing surfaces. However, one drawback of this blade dressing device, is that inserting the blade in the opening formed by the two disks sometimes causes the blade to jump or recoil, creating flaws in the sharpened blade.

SUMMARY

According to one aspect of the present invention, a dressing apparatus for knives or the like is provided. The apparatus includes a pair of disks rotatable about an axis. Each of the disks presents a radially outermost circumferential margin and includes a plurality of axially projecting ribs that each present an axially outermost dressing surface. The disks are oriented in a face-to-face relationship to cooperatively define between the dressing surfaces of the ribs a circumferentially extending opening for receipt of a knife or the like to be dressed when the disks are rotated. Each of the disks include a plurality of circumferentially arranged rib sets each including a plurality of the ribs. The ribs of each rib set are spaced apart with at least portions thereof extending inwardly from the circumferential margin in a generally parallel relationship. The ribs sets of each disk are relatively angularly oriented so that the at least portions of the ribs of adjacent rib sets are nonparallel to one another.

Another aspect of the present invention concerns a dressing disk for use in a dressing apparatus for knives or the like. The disk includes a base presenting an outer circumferential margin and a plurality of ribs projecting axially outward from the base. Each rib defines an axially outermost dressing surface. The ribs cooperatively present a plurality of circumferentially arranged rib sets each including a plurality of the ribs, with adjacent ones of the ribs of each rib set being spaced apart so as to receive a rib of the other disk of the pair therebetween. The ribs of each rib set include at least portions thereof that extend inwardly from the circumferential margin in a generally parallel relationship. The rib sets are relatively angularly oriented so that the at least portions of the ribs of adjacent rib sets are nonparallel to one anothers Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

DETAILED DESCRIPTION

Figure 1:
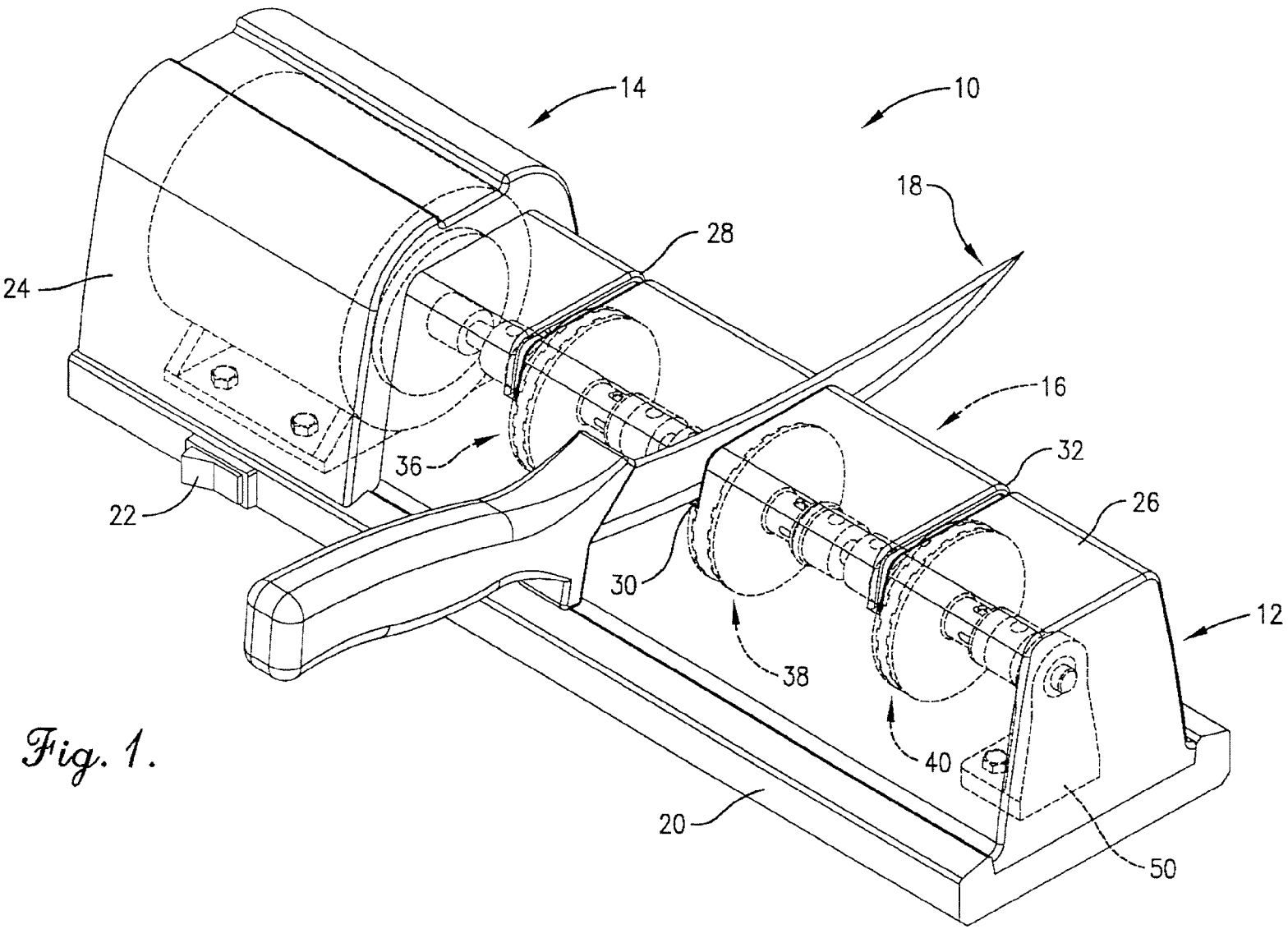
FIG. 1 is a perspective view partially in phantom, of a preferred knife sharpener apparatus in accordance with the invention, shown during sharpening of a knife.

Turning now to the drawings, a knife sharpening apparatus 10 is depicted in FIG. 1 and broadly includes a housing 12 having a conventional, internal electrical drive motor 14 and a sharpening assembly 16 operatively connected with motor 14. The purpose of apparatus 10 is to sharpen a knife blade 18 or other similar object or utensil for cutting purposes. As will be described, however, the principles of the present invention are equally applicable to other types of knife blade dressing devices, such as a knife blade steeler.

In more detail, the illustrated housing 12 includes a base 20 sized to support motor 14 and assembly 16. The housing is preferably equipped with a motor off-on switch 22. The housing 12 also has an upstanding, arcuate motor cover 24 supported on base 20, as well as a laterally projecting cover 26 disposed over the assembly 16. The cover 26 has three spaced apart access slots 28, 30 and 32 formed therein and located to permit access to the operative components of assembly 16 as will be explained.

The sharpening assembly 16 is best illustrated in FIGS. 2-8 and includes an elongated, circular in cross section drive shaft 34 operatively connected to motor 14 for rotation therewith. The illustrated assembly 16 further includes three separate axially spaced apart dressing disk pairs 36,38,40 mounted on shaft 34. The shaft 34 also supports a pair of end mounts 42,44 respectively adjacent the disk pairs 36,40, and intermediate mounts 46,48 located between disk pair 36 and disk pair 38 and intermediate mounts 47,49 located between disk pair 38 and disk pair 40. The outer end of shaft 34 remote from motor 14 is rotatably supported by upstanding bearing fixture 50 secured to base 20.

Figure 2:
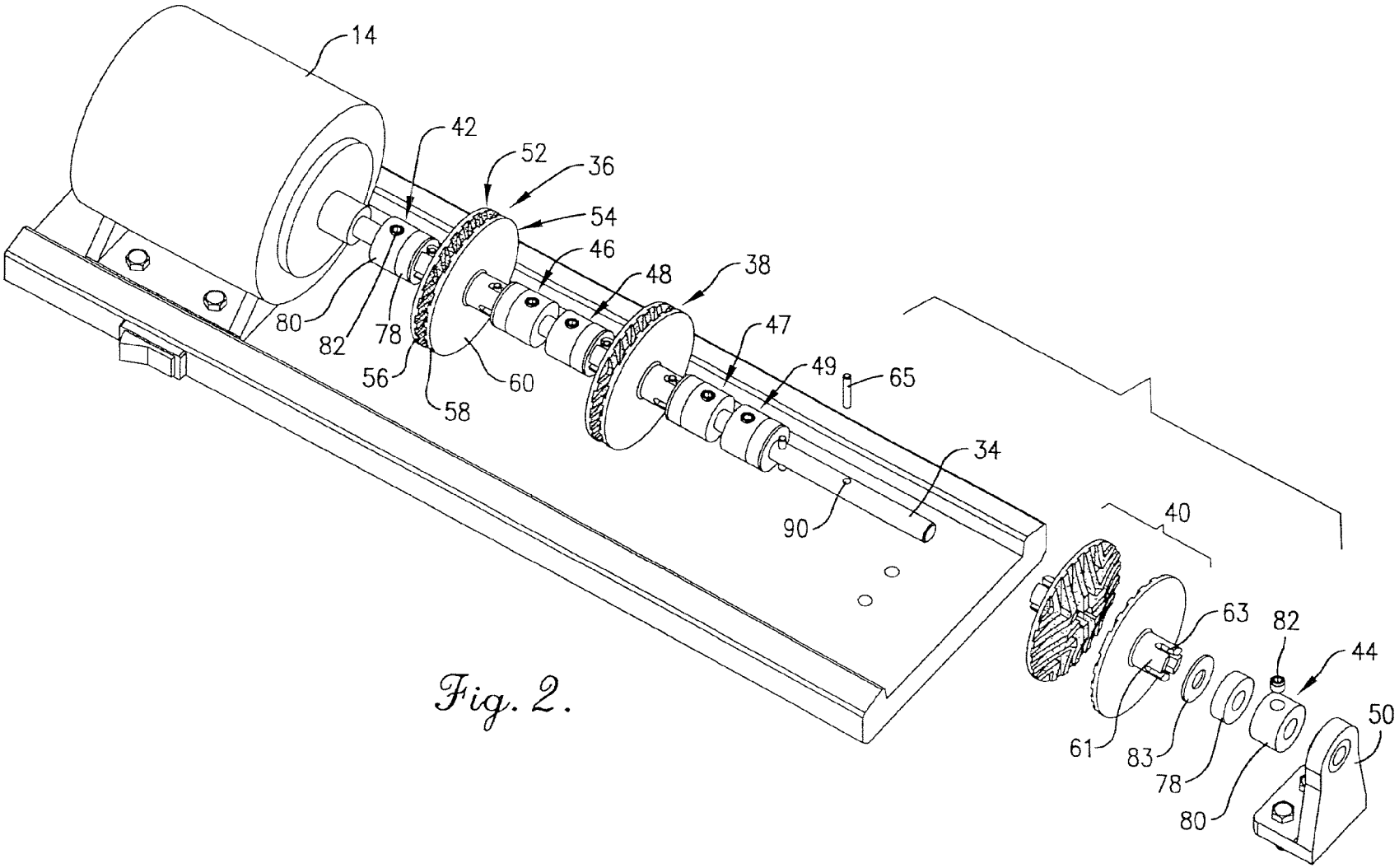
FIG. 2 is a partially exploded perspective view of the operative components of the sharpener depicted in FIG. 1.
Figure 3:
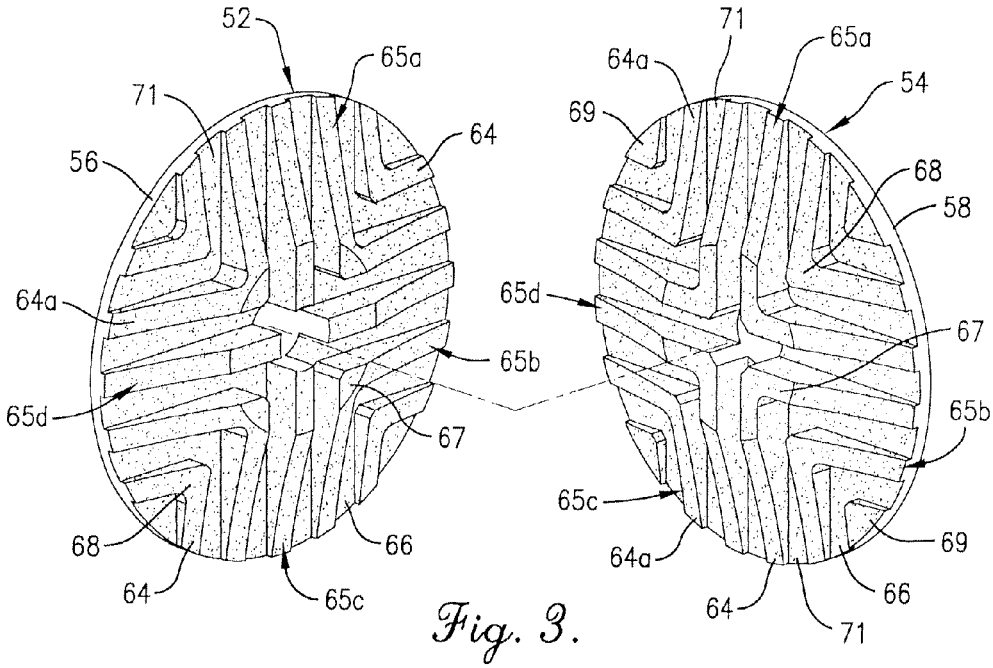
FIG. 3 is an orthogonally exploded view of a pair of rotatable disks forming a part of the FIG. 1 sharpener.

Each of the dressing disk pairs 36,38,40 is structurally identical, except for the nature of the abrasive carried thereby as will be explained. In detail, and referring to FIG. 2 and FIG. 3 illustrating the disks 52,54 making up pair 36, it will be observed that each disk 52,54 has a circular base 56,58 presenting an outer margin 59, an essentially planar back face 60, and a central, circular drive-shaft-receiving opening 62. Although the illustrated disks 52,54 are circular in shape, it will be understood by those of ordinary skill in the art that other suitable disk shapes (e.g., polygonal, elliptical, etc.) are within the ambit of the present invention. Therefore, the terms "radial" and "circumferential" (and other similar terms) as used herein do not relate only to circular shapes, but rather refer to the relationship relative to the rotational axis and the outer perimeter of the disk, respectively. Extending from the boundaries of the drive-shaft-receiving opening 62 is a tubular section 61 protruding outward from the planar back face 60 of each disk. The tubular section 61 of each disk has four anchoring slots 63 formed at its outer end and operable to receive a pin 65 inserted through a hole 90 in the drive shaft 34 to rotatably fix the disks in place relative to the drive shaft 34.

As illustrated in FIG. 3, the forward face of each disk is defined by a plurality of dressing ribs 64. Each rib 64 projects axially (relative to the rotational axis of the disks) from the respective base to present an axially outermost dressing surface 64*a* (see FIGS. 3-5). Preferably, the dressing surfaces 64*a* each have a concave shape and, more specifically, are configured to provide a gothic-arch edge profile to the knife blade dressed by the rotating disks. This configuration is disclosed in the '558 patent, which is hereby incorporated by reference herein.

Figure 4:
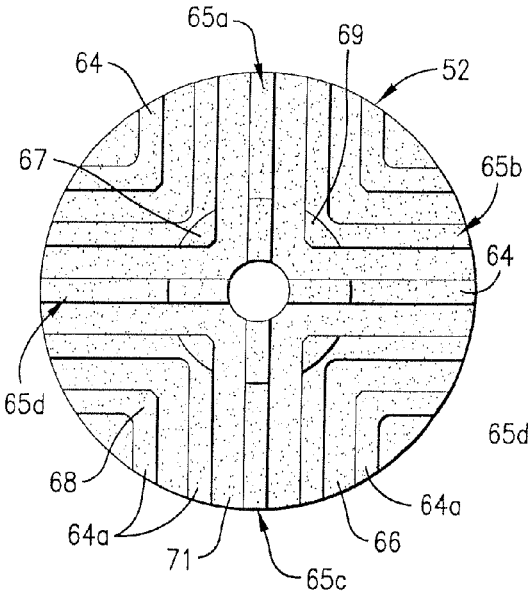
FIG. 4 is an elevation view of the face of one of the disks.
Figure 5:
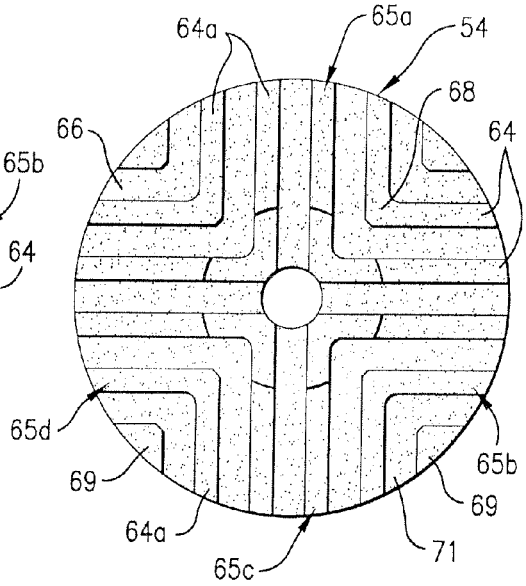
FIG. 5 is an elevation view of the face of the disk that intercalates with the disk shown in FIG. 4.

As perhaps best shown in FIGS. 4 and 5, the ribs 64 of each disk are arranged into four (4) rib sets 65*a*,65*b*,65*c*,65*d* which are located circumferentially about the disk, although alternative numbers of sets (e.g., more or less than four sets) may be provided. The illustrated rib sets 65*a*,65*b*,65*c*,65*d* are defined within respective quadrants (i.e., equal areas) of each disk; however, it is also within the ambit of the present invention to make one or more of the rib sets larger in area than others. It is particularly noted that each rib set includes multiple ribs 64, with at least the radially outer portions of the ribs in the set being generally parallel. Moreover, the ribs of adjacent ribs sets are nonparallel and, most preferably, perpendicular relative to one another. It is believed that this configuration is particularly useful in reducing the risk of blade jumping and recoiling that is common with traditional sharpening disks.

Returning specifically to the illustrated embodiment, the ribs 64 extend radially inward from the circumferential margin 59 of each disk 52,54 and, most preferably, from the outer radial edge of the disk (although the principles of the present invention are equally applicable to ribs that terminate slightly inward from the edge). It is also noted that the ribs 64 preferably have an axial thickness (measured from the corresponding face 66 of the respective base 56,58) that tapers in a radial direction such that the dressing surface 64*a* slopes toward the respective base 56,58 (in a radially outward direction). It is noted, however, that the ribs 64 of each disk cooperatively present a central, circular-shaped, flat area 67. That is to say, a number of the ribs 64 of each of disk 52,54 are un-tapered in the central area 67.

In particular regard to disk 52, all of the ribs 64 are generally linear and present a constant width along their length (the length being defined in the direction the rib extends from the circumferential margin 59). Furthermore, the ribs preferably have the same width and present equal spacing therebetween. As will be explained, the spacing between adjacent ribs in a set corresponds with the dimension and shape of the respective rib of the disk 54, thereby providing a snug fit between the disks 52,54. It is also noted that all of the ribs 64 of each rib set 65*a*,65*b*,65*c*,65*d*, except the centermost rib, joins with a rib of the adjacent rib set to form a combined rib. The combined rib is consequently continuous from spaced apart points along the outer margin 59 of the disk 52. That is, a pair of the ribs extend from spaced apart points of intersection with the disk edge toward the disk center to join together, without intersecting with another rib 64 on the face of the disk. Preferably, each combined rib presents a V-shape and forms a right angle, although other combined rib shapes and configurations are within the ambit of the present invention. It is also noted that the ribs that cooperatively form the V-shaped combined rib join at a radial junction 68, which is preferably common to all of the combined ribs defined between the corresponding pair of rib sets. Therefore, in the preferred embodiment, each quadrant (or rib set) is defined between adjacent ones of the junctions 68. Finally, it is noted that the rib sets 65*a*,65*b*,65*c*, 65*d* of the disk 52 are preferably symmetrical, with each set including a centermost rib and four (4) outer ribs, for a total of five (5) equally spaced and configured ribs in each set.

The disk 54 is similarly constructed but has its ribs 64 and rib sets 65*a*,65*b*,65*c*,65*d* arranged in "mirror image" to that of disk 52. All of the ribs 64 of the disk 54 combine with a rib of an adjacent set to form a combined V-shaped rib. In fact, the radially outermost ribs of the adjacent sets cooperatively form a small triangular-shaped combined rib 69.

As an exemplary embodiment, the disks 52,54 are about two (2) inches in diameter and the linear ribs have a width of about ⅛ inch (with the groove having a slightly larger dimension than ⅛ inch). In this exemplary embodiment, the drive-shaft-receiving opening 62 is about ¼ inch in diameter, and the tubular section 61 protruding from the planar back face 60 is about ½ inch in length. The circular center portion 67 of this embodiment is between about ¾ inch and one (1) inch in diameter and the portions of the ribs 64 within the circular center portion 67, measuring from the face 66 of the disk axially outward, have a thickness of approximately ⅛ inch, with the radially outermost edges of the ribs tapering down to a height of about 1/16 inch (measured again from the face 66 of the disk base 56). Obviously, depending on the application and the size and type of blade to be sharpened, the dimensions of the disk and its parts could vary from this exemplary embodiment.

It has been determined that it is critical for the rib sets 65*a*,65*b*,65*c*,65*d* to present ribs 64 with outer portions (extending from the outer margin 59) that are parallel with one another but not parallel with the ribs of adjacent rib sets. For example, the ribs in each rib set may alternatively present radially inward portions that are not parallel with the other ribs of the set. For example, one or more of the ribs of each set could present a zigzag or arcuate shaped radially inner portion. However, in the most preferred embodiment, the ribs 64 of each rib set are entirely parallel with one another (i.e., linear along the entire length thereof) and perpendicular to the ribs of adjacent rib sets. Furthermore, all of the ribs on each disk are preferably part of one of the rib sets, although it is possible to have one or more ribs not included in one of the rib sets.

The dressing surfaces 64*a* of each disk pair 36,38,40 have different abrasive surfaces. The surfaces 64*a* of pair 36 carry the coarsest abrasive, whereas the surfaces 64*a* of pairs 38 and 40 are progressively less coarse. More particularly, the disks are preferably formed of a suitable rigid, non-corrosive material, such as stainless steel or Aluminum. Furthermore, the abrasive nature of the surfaces 74 is preferably formed by adhering a grit to the underlying portion of the disk. Suitable grit materials include Silicon Carbide or Aluminum Oxide, with the grit size increasing from disk 36 to disk 40.

Those ordinarily skilled in the art will also appreciate that the apparatus may include more or less disk pairs than shown. For example, the apparatus may alternatively be provided with only one disk pair or two disk pairs of different abrasive qualities. In the single pair arrangement, the surfaces of the ribs may alternatively be smooth (e.g., a smooth stainless steel surface) so as to provide a steeler for the knife blade. A steeler may also be provided in the multiple pair apparatuses, such that sharpening and steeling of a blade can be achieved with a single apparatus.

Returning to the illustrated embodiment, the disks 52,54 making up each of the disk pairs 36,38,40 are oriented in face-to-face relationship with the ribs 64 of disk 52 received within the opposing openings 71 of disk 54, and vice-versa. In this manner, the ribs are in a meshed, intercalated relationship and thereby cooperatively define a circumferentially extending, outer blade-receiving opening 76 extending around the entire periphery of the disk pairs.

Figure 6:
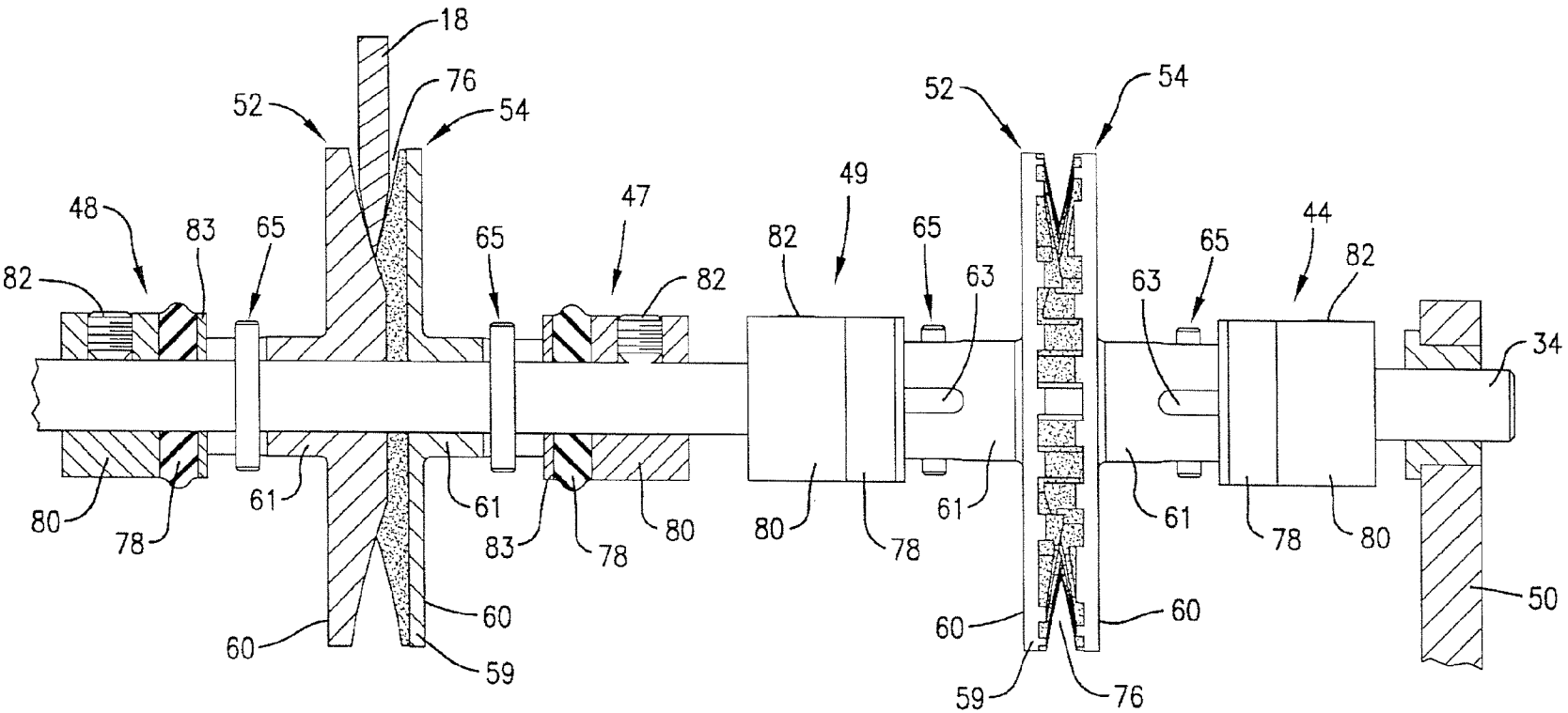
FIG. 6 is a fragmentary view in partial vertical section illustrating in detail the biased-together intercalated relationship of two pairs of the rotatable disks (one of which is not sectioned), with a knife blade being shown between one of the pairs of disks.
Figure 8:
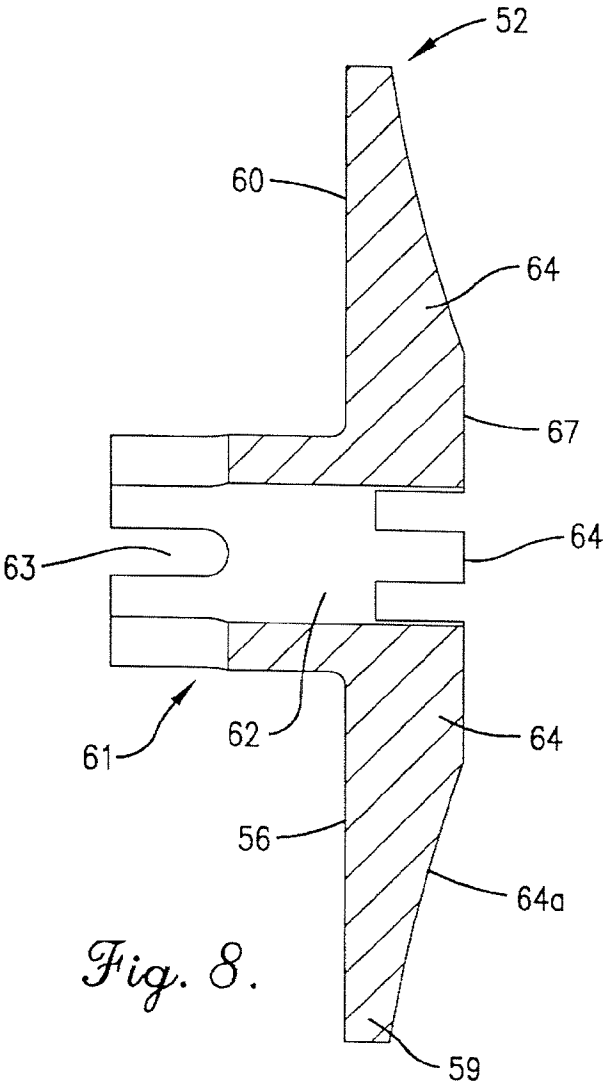
FIG. 8 is an enlarged view in partial vertical section illustrating the tapering configuration of the ribs forming a part of the disks.
Figure 7:
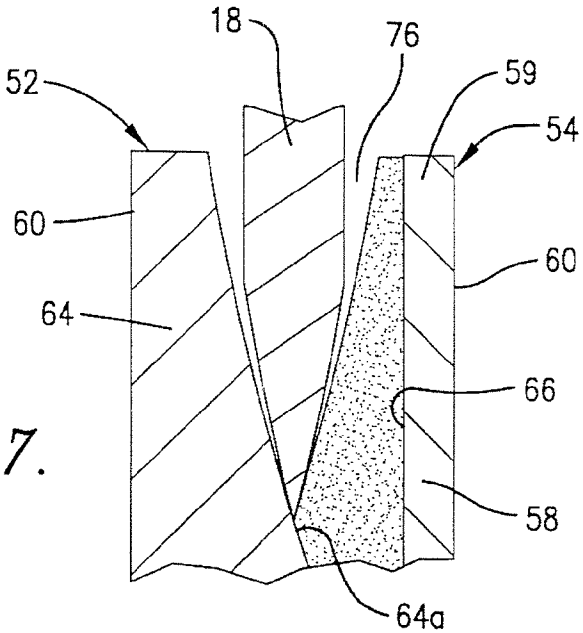
FIG. 7 is an enlarged, fragmentary view from FIG. 6 illustrating in detail the orientation of a pair of the disks with a knife blade inserted therebetween.

The disk pair mounts 42,44,46-49 are designed to provide proper spacing between the disk pairs 36,38,40, and also to resiliently bias together the disks 52,54 of each pair. To this end, the mounts 42,44, 46-49 include a resilient elastomeric biasing ring 78 supported on shaft 34, as well as a locking ring 80 also on shaft 34. The ring 80 is equipped with a set screw 82. The latter engages the outer face of shaft 34 to hold the ring 78 in place against disk rear face 60 of the disks 56,58 (although a washer 83 may be interposed between the ring 78 and disk face 60, if desired). As best illustrated in FIG. 6, the mounts 42 48 are secured to shaft 34 in a manner to normally bias the disks 52,54 of each disk pair together, thereby insuring that during rotation of the disks the latter remain in their operative, intercalated relationship. The bias also provides proper engagement with the knife blade during rotation of the disks and insertion of the blade into the opening 76. It is also within the ambit of the present invention to utilize helical springs or other suitable component(s) for yieldably biasing the disks of each pair toward one another.

Again referring to FIG. 1, it will be noted that the respective access slots 28,30,32 are oriented to overlie the disk pairs 36,38,40, and particularly to allow access to the blade-receiving openings 76 presented by each such disk pair.

In the use of apparatus 10, motor 14 is activated by switch 22, thereby causing the disk pairs 36,38,40 to rotate. The user then places blade 18 first within slot 28 so as to effect coarse sharpening of the blade by the action of the dressing surfaces 74 of disk pair 36. During such sharpening, the user presses the blade 18 downwardly and moves the blade lengthwise (e.g., backwards and forwards) within the opening 76 to assure even sharpening. The downward pressing of the blade 18 serves to slightly separate the disks 52,54 against the bias of the adjacent resilient rings 78. See FIGS. 6 and 7 where downward force of the blade 18 serves to radially expand the rings 78. It is specifically noted that the illustrated rib arrangement is particularly effective in preventing the blade 18 from jumping or recoiling when engaging the rotating disks 52,54. This ensures that the blade 18 is more uniformly sharpened (or dressed) along its length. Furthermore, with the preferred configuration of the dressing surfaces 64*a*, the blade is provided with gothic-arch edge profile that is consistent along the blade length.

After coarse sharpening is completed, the user then preferably repeats this same sharpening action, using the intermediate disk pair 38 and finally the endmost disk pair 40. Inasmuch as these disk pairs have finer abrasive dressing surfaces 74, the blade 18 is finely sharpened to create the desirable cutting edge on blade 18.

If desired, the paired disk arrangement may be provided as a part of a portable, handheld dressing device (not shown). Such a device is disclosed in the '558 patent, which has been incorporated by reference herein.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

The invention claimed is:

1. A dressing apparatus for knives or the like, said apparatus comprising:

a pair of disks rotatable about an axis, each of the disks presenting a radially outermost circumferential margin and including a plurality of axially projecting ribs that each present an axially outermost dressing surface, said disks being oriented in a face-to-face relationship to cooperatively define between the dressing surfaces of the ribs a circumferentially extending opening for receipt of a knife or the like to be dressed when the disks are rotated, each of said disks including a plurality of circumferentially arranged rib sets each including a plurality of the ribs, said ribs of each rib set being spaced apart with at least portions thereof extending inwardly from the circumferential margin in a generally parallel relationship, such that adjacent ribs of each set present substantially constant spacing between said at least portions thereof, said rib sets of each disk being relatively angularly oriented so that said at least portions of the ribs of adjacent rib sets are nonparallel to one another.

2. The apparatus as claimed in claim 1, said rib sets of each of the disks intermeshing and intercalating with the rib sets of the other disk, with each rib of a respective disk being positioned between a respective pair of ribs of the other disk.

3. The apparatus as claimed in claim 2,
said rib sets of each disk being oriented so that said at least portions of the ribs of adjacent rib sets are substantially perpendicular to one another.

4. The apparatus as claimed in claim 3,
each of said disks including four rib sets that are arranged into respective quadrants of the respective disk.

5. The apparatus as claimed in claim 4,
said rib sets of each disk being symmetrical.

6. The apparatus claimed in claim 5,
each of said ribs of the rib sets presenting a width, as measured transversely relative to the direction the rib extends from the circumferential margin, that is slightly undersized relative to the spacing presented by a respective pair of ribs of the other disk between which the rib is positioned.

7. The apparatus as claimed in claim 6,
at least some of the ribs of each rib set being generally symmetrical and substantially linear to present a generally common and constant rib width.

8. The apparatus as claimed in claim 1,
each of said rib sets including at least three of the ribs.

9. The apparatus as claimed in claim 1,
said dressing surfaces being coated with an abrasive grit.

10. The apparatus as claimed in claim 1,
each of said ribs presenting an axial depth that tapers toward the circumferential margin such that the dressing surface thereof slopes away from the other disk.

11. The apparatus as claimed in claim 1,
said disks being resiliently biased together.

12. The apparatus as claimed in claim 11; and
a rotatable drive shaft supporting said disks, with the drive shaft defining the axis.

13. The apparatus as claimed in claim 12,
said drive shaft supporting a plurality of axially spaced apart pairs of said disks.

14. The apparatus as claimed in claim 12; and
a motor operatively coupled with the drive shaft for powered rotation thereof.

15. A dressing apparatus for knives or the like, said apparatus comprising:
a pair of disks rotatable about an axis,
each of the disks presenting a radially outermost circumferential margin and including a plurality of axially projecting ribs that each present an axially outermost dressing surface,
said disks being oriented in a face-to-face relationship to cooperatively define between the dressing surfaces of the ribs a circumferentially extending opening for receipt of a knife or the like to be dressed when the disks are rotated,
each of said disks including a plurality of circumferentially arranged rib sets each including a plurality of the ribs,
said ribs of each rib set being spaced apart with at least portions thereof extending inwardly from the circumferential margin in a generally parallel relationship,
said rib sets of each disk being relatively angularly oriented so that said at least portions of the ribs of adjacent rib sets are nonparallel to one another,
said rib sets of each of the disks intermeshing and intercalating with the rib sets of the other disk, with each rib of a respective disk being positioned between a respective pair of ribs of the other disk,
said rib sets of each disk being oriented so that said at least portions of the ribs of adjacent rib sets are substantially perpendicular to one another,
each of said disks including four rib sets that are arranged into respective quadrants of the respective disk,
each of said disks including a pair of ribs from each adjacent pair of rib sets that join along a radial junction to form a V-shaped, generally right-angled combined rib.

16. A dressing disk for use in a dressing apparatus for knives or the like, wherein the apparatus utilizes a pair of the disks yieldably biased toward one another to cooperatively present a circumferential dressing opening for receiving a knife or the like to be dressed when the disks are rotated about an axis, said dressing disk comprising:
a base presenting an outer circumferential margin; and
a plurality of ribs projecting axially outward from the base and each defining an axially outermost dressing surface,
said ribs cooperatively presenting a plurality of circumferentially arranged rib sets each including a plurality of the ribs, with adjacent ones of the ribs of each rib set being spaced apart so as to receive a rib of the other disk of the pair therebetween,
said ribs of each rib set including at least portions thereof that extend inwardly from the circumferential margin in a generally parallel relationship, such that adjacent ribs of each set present substantially constant spacing between said at least portions thereof,
said rib sets being relatively angularly oriented so that said at least portions of the ribs of adjacent rib sets are nonparallel to one another.

17. The dressing disk as claimed in claim 16,
said rib sets being oriented so that said at least portions of the ribs of adjacent rib sets are substantially perpendicular to one another.

18. The dressing disk as claimed in claim 17,
said ribs presenting four ribs sets that are arranged into respective quadrants of the disk.

19. The dressing disk as claimed in claim 18,
said rib sets being symmetrical.

20. The dressing disk as claimed in claim 19,
each of said ribs of the rib sets presenting a width, as measured transversely relative to the direction the rib extends from the circumferential margin,
at least some of the ribs of each rib set being generally symmetrical and substantially linear to present a generally common and constant rib width.

21. The dressing disk as claimed in claim 20,
adjacent ribs of each rib set presenting a space therebetween that is slightly oversized relative to the width of said at least some of the ribs.

22. The dressing disk as claimed in claim 16,
each of said rib sets including at least three of the ribs.

23. The dressing disk as claimed in claim 16,
said dressing surfaces being coated with an abrasive grit.

24. The dressing disk as claimed in claim 16,
each of said ribs presenting an axial depth that tapers toward the circumferential margin such that the dressing surface thereof slopes toward the base.

25. A dressing disk for use in a dressing apparatus for knives or the like, wherein the apparatus utilizes a pair of the disks yieldably biased toward one another to cooperatively present a circumferential dressing opening for receiving a knife or the like to be dressed when the disks are rotated about an axis, said dressing disk comprising:
a base presenting an outer circumferential margin; and
a plurality of ribs projecting axially outward from the base and each defining an axially outermost dressing surface,
said ribs cooperatively presenting a plurality of circumferentially arranged rib sets each including a plurality of the ribs, with adjacent ones of the ribs of each rib set being spaced apart so as to receive a rib of the other disk of the pair therebetween, said ribs of each rib set including at least portions thereof that extend inwardly from the circumferential margin in a generally parallel relationship, said rib sets being relatively angularly oriented so that said at least portions of the ribs of adjacent rib sets are non-parallel to one another, said rib sets being oriented so that said at least portions of the ribs of adjacent rib sets are substantially perpendicular to one another, said ribs presenting four ribs sets that are arranged into respective quadrants of the disk, at least two of said ribs from each adjacent pair of rib sets joining along a radial junction to form a V-shaped, generally right-angled combined rib.

* * * * *